US005657862A

United States Patent [19]

Burke

[11] Patent Number: 5,657,862

[45] Date of Patent: Aug. 19, 1997

[54] SPARE KEY HOLDER

[76] Inventor: Stephen Burke, 2860 Liholani St., Pukalani, Hi. 96768

[21] Appl. No.: 555,929

[22] Filed: Nov. 13, 1995

[51] Int. Cl.[6] ..... A45C 11/32

[52] U.S. Cl. ..... 206/38.1; 206/37.4; 383/86; 248/205.2

[58] Field of Search ..... 206/37.1, 37.4, 206/37.6, 37.8, 38.1; 383/86, 106; 248/205.2, 205.3, 311.2; 70/456 R

[56] References Cited

U.S. PATENT DOCUMENTS

| | | | |
|---|---|---|---|
| 2,066,526 | 1/1937 | Gladstone | 206/37.4 |
| 2,305,402 | 12/1942 | Avery et al. | 383/86 |
| 2,629,251 | 2/1953 | Schwalberg | 206/38.1 |
| 3,261,126 | 7/1966 | Marks | 248/205.3 |
| 3,310,225 | 3/1967 | Hoblit et al. | 383/86 |
| 3,557,853 | 1/1971 | Jones | 383/86 |
| 4,548,846 | 10/1985 | Kurtz | 248/205.3 |
| 4,988,216 | 1/1991 | Lyman | 383/86 |
| 5,286,112 | 2/1994 | Bible | 383/86 |

*Primary Examiner*—Paul T. Sewell
*Assistant Examiner*—Nhan T. Lam
*Attorney, Agent, or Firm*—Michael I. Kroll

[57] ABSTRACT

An improved spare key holder (10) comprising a panel member (12). A lid (14) is hinged to the panel member (12) along a top fold line (16). A pocket (18) is formed on an inner face of the panel member (12) for holding a spare key (20) therein. A structure (22) is for fastening in a releasing manner the lid (14) in a fold down closed position over the pocket (18). A facility (24) is for adhering an outer face of the panel member (12) to a smooth flat surface (26) of an object (28).

11 Claims, 2 Drawing Sheets

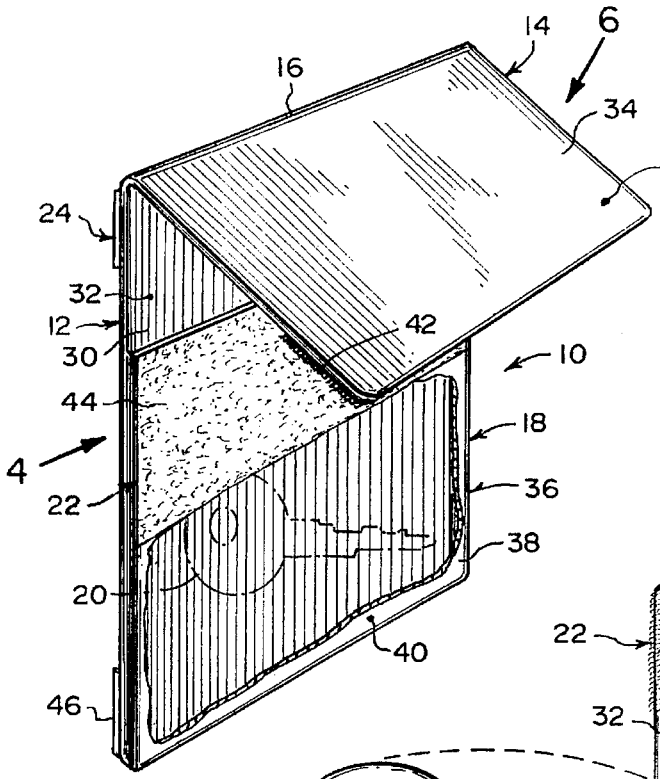
Fig. 3
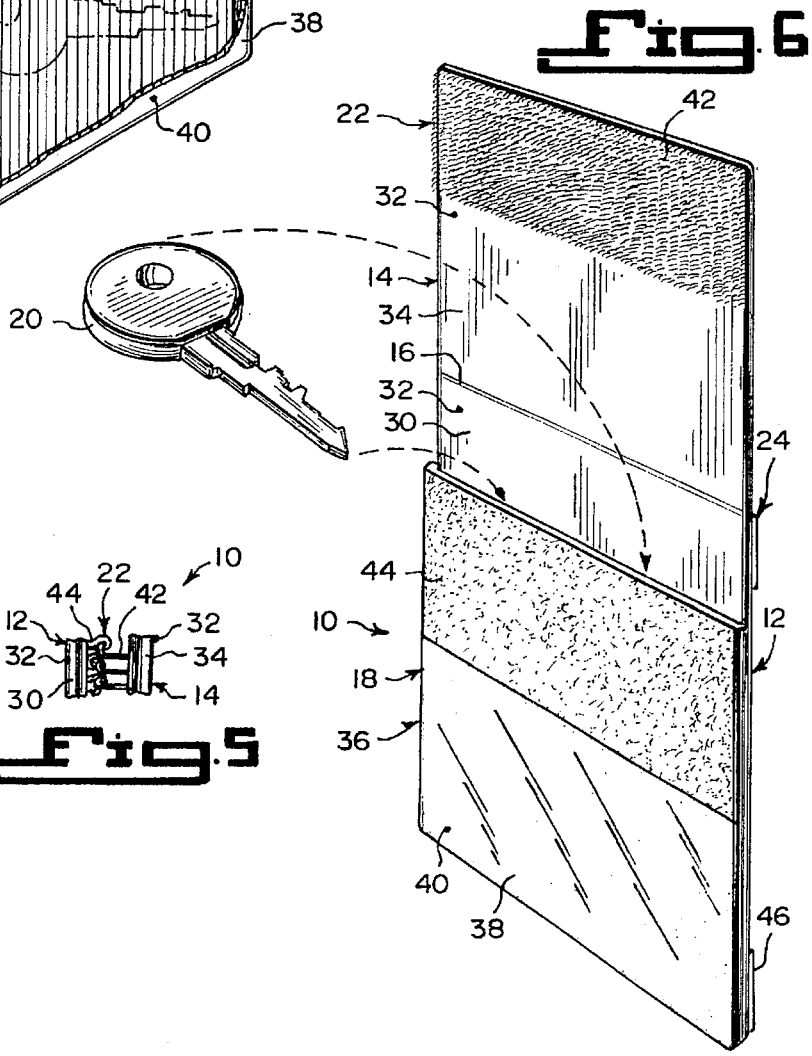
Fig. 6
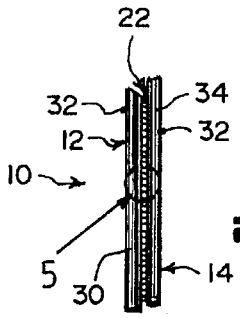
Fig. 4
Fig. 5

SPARE KEY HOLDER

BACKGROUND OF THE INVENTION

1. Field of the Invention

The instant invention relates generally to key retainers and more specifically it relates to an improved spare key holder.

2. Description of the Prior Art

Numerous key retainers have been provided in prior art. For example, U.S. Pat. Nos. 4,397,438 to Chapman; 4,457,425 to Cooper et al.; 4,860,563 to Gerch and 4,964,508 to Balsley all are illustrative of such prior art. While these units may be suitable for the particular purpose to which they address, they would not be as suitable for the purposes of the present invention as heretofore described.

A clip type fastener for attachment to a mounting or supporting element, as the handle of a tool box or tool box drawer, for wedgingly receiving an article, as a key for the tool box lock, in accessible position to insert or remove the same relative to a mounting recess in the fastener body portion from which spaced legs extend in directions for selectively and resiliently gripping mounting or support elements, as handles, of different cross-sectional configurations. Outer legs being adapted for snap engagement and mounting on the web portion of a formed angle or beam type, as a T-angle, mounting element or handle with an intermediate leg acting as a strut against the web portion for properly positioning the fastener thereon. An outer leg and an intermediate leg are adapted for snap engagement and mounting on a handle or other supporting element of generally uniform cross section, as an extruded aluminum element, for properly positioning the fastener thereon.

Magnetic holder for keys and the like embodying this invention is in the form of a unitary extrusion of synthetic plastic, magnetic material. The extrusion has a planar web portion, and a key-shaped cutout is provided through the base portion of said magnetic material. The extrusion includes longitudinal, inwardly opening side edge channels, and the sheet is slidably insertable within said channels as a closure for one side of the key shaped cutout. Also disclosed is a method of manufacturing such key holders which includes the steps of extruding a unitary, continuous strip of synthetic plastic magnetic material with a planar web portion and inturned longitudinal edge channels. A key-shaped cutout is punched through the web portion of the magnetic strip, and a flat panel is fitted over one side of the key-shaped cutout, with the edges of the panel disposed in the channels.

Luggage, such as hand carried briefcases, purses or the like, are provided with key ring holders on an inner face thereof, preferably a cover. The holder is in the form of a short horizontal or longitudinal strap secured at its midsection to the face just above and open top of a conventional pocket or envelope mounted on the inner face. The strap has wings or legs projecting from its secured mid portion. The end of each wing or leg has a pad of a hook and loop (VELCRO) fastener secured on its inner side. A complimentary hook and loop pad is secured to the opposing inner face of the cover at a location to secure the outer ends of the wings or legs in an extended flat condition against the cover. The two wings or legs are pulled free of the cover carried pads, and are brought together on opposite sides of their secured mid portion. A key carrying key ring is draped over the juxtaposed wings which are then spread apart back to their original extended positions and pressed against the cover pads to trap the key ring on opposite sides of the secured central portion of the strap. The keys on the key ring are dropped into the mouth of the pocket or envelope to be held flatwise in an easily accessible position until needed.

A cache or holder for a key or other small item comprises a first part having at least one pocket for holding a key and a second part releasably securable to the first part. An adhesive layer or other securing device is for securing the second part to a selected surface in a concealed location.

SUMMARY OF THE INVENTION

A primary object of the present invention is to provide an improved spare key holder that will overcome the shortcomings of the prior art devices.

Another object is to provide an improved spare key holder that can be adhered to a smooth surface made of any type of material, and once secured thereto it will be unlikely to jar loose from the smooth surface.

An additional object is to provide an improved spare key holder in which a person can see the spare key through a transparent pocket, when the spare key is inserted into the transparent pocket and held therein by a lid which is maintained in a fold down closed position by a VELCRO fastener.

A further object is to provide an improved spare key holder that is simple and easy to use.

A still further object is to provide an improved spare key holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a further enlarged perspective view of the instant invention per se taken in the direction of arrow 3 in FIG. 2, with the lid partly opened and the transparent window broken away.

FIG. 4 is a side view taken in the direction of arrow 4 in FIG. 3, with the lid closed and parts broken away.

FIG. 5 is an enlarged side view as indicated by arrow 5 in FIG. 4, showing a portion of the loop pile strip in engagement with a portion of the hook pile strip of the VELCRO fastener in greater detail.

FIG. 6 is a perspective view taken in the direction of arrow 6 in FIG. 3, with the lid fully opened and showing the spare key ready to be inserted into the pocket.

Similar reference characters denote corresponding features consistently throughout the attached drawings.

DETAILED DESCRIPTION OF THE PREFERRED EMBODIMENTS

Figure 1:
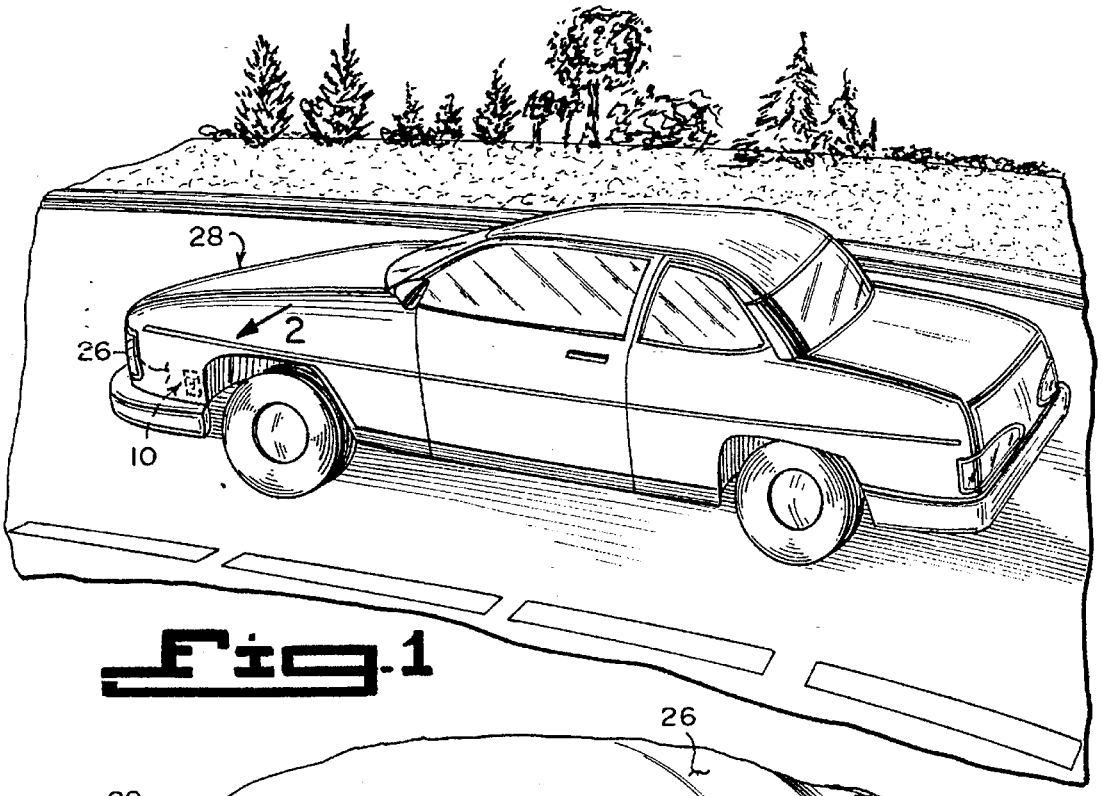
FIG. 1 is a perspective view of a motor vehicle showing the instant invention installed in a hidden place.
Figure 2:
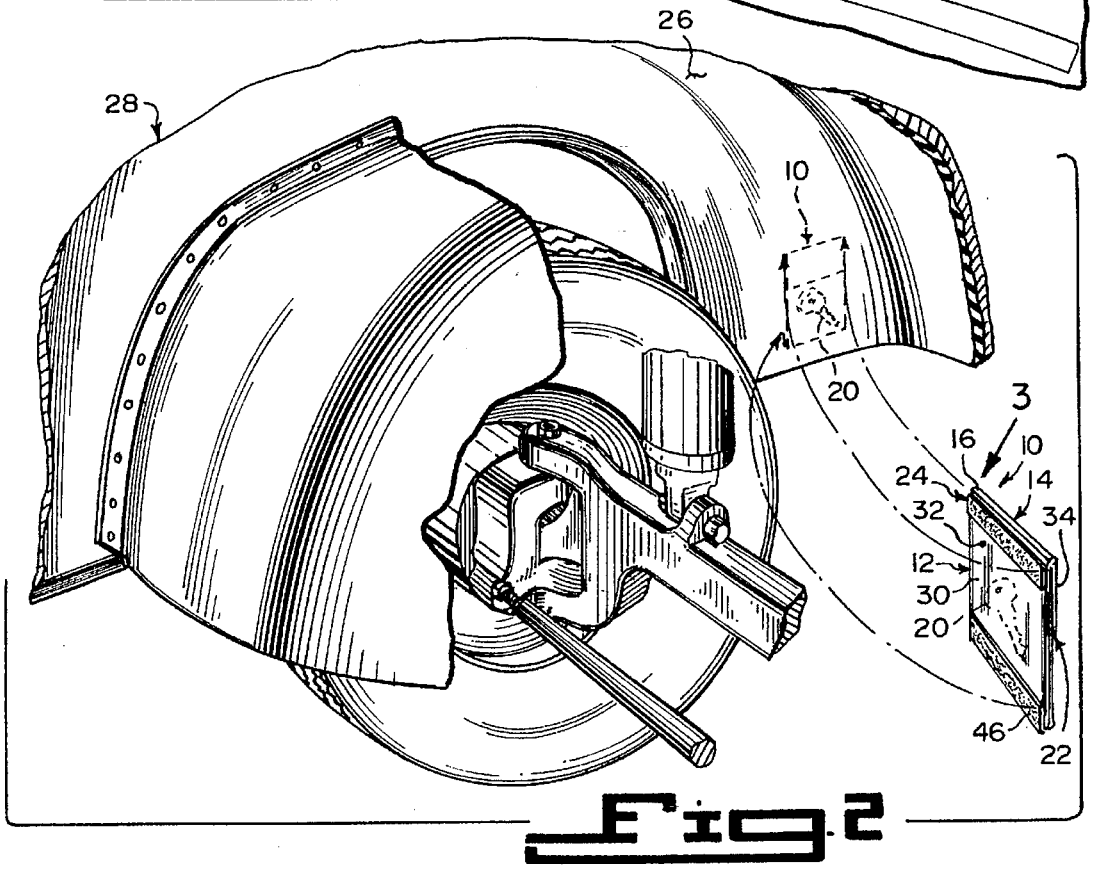
FIG. 2 is an enlarged perspective view of an interior portion of the motor vehicle taken in the direction of arrow 2 in FIG. 1, showing the instant invention ready to be installed in the hidden place.

Turning now descriptively to the drawings, in which similar reference characters denote similar elements throughout the several views, FIGS. 1 through 6 illustrate an improved spare key holder 10 comprising a panel member 12. A lid 14 is hinged to the panel member 12 along a top fold line 16. A pocket 18 is formed on an inner face of the panel member 12, for holding a spare key 20 therein. A structure 22 is for fastening in a releasing manner the lid 14 in a fold down closed position over the pocket 18. A facility 24 is for adhering an outer face of the panel member 12 to a smooth flat surface 26 of an object 28. The smooth flat surface 26 can be an inner portion of a fender adjacent a front wheel of a motor vehicle which can be the object 28, as shown in FIGS. 1 and 2. Other hidden surfaces (not shown) can also be utilized to secure the holder 10 thereto.

The panel member 12 is a rectangular shaped flat piece of rigid material 30. The panel member 12 is fabricated out of plastic 32. The lid 14 is a square shaped flat piece of rigid material 34. The lid 14 is also fabricated out of plastic 32. The panel member 12 is of the same width as the lid 14 and is integral with the lid 14 along the top fold line 16.

The pocket 18 is a plate 36, being of the same width of the panel member 12, but slightly shorter in height. The plate 36 is secured along a bottom edge and two side edges to the inner face of the panel member 12, thereby having an open top edge to receive the spare key 20 therein. The plate 36 is a square shaped flat piece of semi-rigid material 38. The plate 36 is fabricated out of transparent plastic 40, so that when the spare key 20 is inserted within the pocket 18, it can be viewed through the transparent plastic 40.

The structure 22 is a VELCRO fastener which includes a hook pile strip 42 affixed along an upper portion of an inner face of the lid 14. A loop pile strip 44 is affixed along an upper portion of an inner face of the pocket 18. When the lid 14 is folded down in the closed position over the pocket 18, the hook pile strip 42 will mate with the loop pile strip 44.

The adhering facility 24 consists of a pair of adhesive strips 46, affixed along upper and lower portions of an outer face of the panel member 12. When the outer face of the panel member 12 is pressed against the smooth flat surface 26 of the object 28, the pair of adhesive strips 46 will stick thereto.

OPERATION OF THE INVENTION

To use the improved spare key holder 10, the following steps should be taken:

1. Open the lid 14, so that the hook pile strip 42 disengages from the loop pile strip 44.
2. Insert the spare key 20 into the pocket 18.
3. Close the lid 14, so that the hook pile strip 42 now engages with the loop pile strip 44 to keep the lid 14 down over the pocket 18.
4. Peel off the paper backing from the adhesive strips 46.
5. Press the adhesive strips 46 against the hidden flat surface 26, so that the holder 10 will stick thereto.
6. Open the lid 14 again when the spare key 20 is needed.
7. Remove the spare key 20 from the pocket so that it can be utilized.

LIST OF REFERENCE NUMBERS 10 improved spare key holder
12 panel member of 10

14 lid of 10
16 top fold line between 12 and 14
18 pocket of 10
20 spare key
22 fastening structure of 10
24 adhering facility of 10
26 flat surface of 28
28 object
30 rectangular shaped flat piece of rigid material for 12
32 plastic
34 square shaped flat piece of rigid material for 14
36 plate for 18
38 square shaped flat piece of semi-rigid material for 36
40 transparent plastic for 36
42 hook pile strip of 22
44 loop pile strip of 22
46 adhesive strip of 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved spare key holder in combination with and for containing a spare key on a hidden smooth flat surface of an automobile comprising:

a) a panel member which is a rectangular shaped flat piece of rigid material fabricated out of plastic;

b) a lid hinged to said panel member along a top fold line, said lid being a square shaped flat piece of rigid material fabricated out of plastic and of the same width as said panel member and integral with said panel member along said top fold line;

c) a pocket on an inner face of said panel member for holding said spare key therein, said pocket being formed by a plate being of the same width as said panel member but shorter in height, said plate being secured along a bottom edge and two side edges to said inner face of said panel member, and having an open top edge to receive the spare key therein, said plate being a square shaped flat piece of semi-rigid material fabricated out of transparent plastic permitting said spare key in the pocket to be viewed through said transparent plastic;

d) hook and loop means for fastening in a releasing manner said lid in a fold down closed position over said pocket comprising a hook pile strip affixed along an upper portion of an inner face of said lid and a loop pile strip affixed along an upper portion of an inner face of said pocket, so that when said lid is folded down in the closed position over said pocket said hook pile strip will mate with said loop pile strip; and e) means for adhering an outer face of said panel member to said hidden smooth flat surface of said automobile comprising a pair of adhesive strips affixed along upper and lower portions of an outer face of said panel member so that when the outer face of said panel member is pressed against the smooth flat surface of the object said pair of adhesive strips will stick thereto.

2. An improved spare key holder as recited in claim 1, wherein said panel member is a rectangular shaped flat piece of rigid material.

3. An improved spare key holder as recited in claim 1, wherein said panel member is fabricated out of plastic.

4. An improved spare key holder as recited in claim 1, wherein said lid is a square shaped flat piece of rigid material.

5. An improved spare key holder as recited in claim 1, wherein said lid is fabricated out of plastic.

6. An improved spare key holder as recited in claim 1, wherein said panel member is of the same width as said lid and is integral with said lid along said top fold line.

7. An improved spare key holder as recited in claim 1, wherein said pocket is a plate being of the same width of said panel member but slightly shorter in height, said plate secured along a bottom edge and two side edges to said inner face of said panel member, thereby having an open top edge to receive the spare key therein.

8. An improved spare key holder as recited in claim 7, wherein said plate is a square shaped flat piece of semi-rigid material.

9. An improved spare key holder as recited in claim 7, wherein said plate is fabricated out of transparent plastic, so that when the spare key is inserted within said pocket it can be viewed through said transparent plastic.

10. An improved spare key holder as recited in claim 1, wherein said fastening means is a VELCRO fastener which includes:

a) a hook pile strip affixed along an upper portion of an inner face of said lid; and b) a loop pile strip affixed along an upper portion of an inner face of said pocket, so that when said lid is folded down in the closed position over said pocket, said hook pile strip will mate with said loop pile strip.

11. An improved spare key holder as recited in claim 1, wherein said adhering means includes pair of adhesive strips affixed along upper and lower portions of an outer face of said panel member, so that when the outer face of said panel member is pressed against the smooth flat surface of the object, said pair of adhesive strips will stick thereto.

* * * * *